US008955202B2

(12) United States Patent
Medsker

(10) Patent No.: US 8,955,202 B2
(45) Date of Patent: Feb. 17, 2015

(54) PULL TAB APPARATUS

(71) Applicant: Thomas T. Medsker, Fredericksburg, VA (US)

(72) Inventor: Thomas T. Medsker, Fredericksburg, VA (US)

( * ) Notice: Subject to any disclaimer, the term of this patent is extended or adjusted under 35 U.S.C. 154(b) by 173 days.

(21) Appl. No.: 13/875,567

(22) Filed: May 2, 2013

(65) Prior Publication Data

US 2014/0325801 A1 Nov. 6, 2014

(51) Int. Cl.
*A44B 19/42* (2006.01)
*A44B 19/26* (2006.01)

(52) U.S. Cl.
CPC ..... *A44B 19/262* (2013.01); *A44B 19/42* (2013.01)
USPC ..... 24/429

(58) Field of Classification Search
USPC ..... 24/429
See application file for complete search history.

(56) References Cited

U.S. PATENT DOCUMENTS 6,332,345 B1 * 12/2001 Huang ..... 70/456 R
7,213,306 B2 5/2007 Medsker
7,454,819 B2 11/2008 Wu
8,205,306 B2 6/2012 Kovach et al.
2002/0069494 A1 * 6/2002 McCrum ..... 24/429
2006/0242804 A1 * 11/2006 Griffiths ..... 24/431

* cited by examiner

*Primary Examiner* — Robert J Sandy
*Assistant Examiner* — David Upchurch
(74) *Attorney, Agent, or Firm* — Jeffrey D. Carter

(57) ABSTRACT

A pull tab apparatus is easily connected to and disconnected from an external item such as a slide fastener and/or other item/article by a user, and is also easily assembled and disassembled by the user. According to exemplary embodiments, the pull tab apparatus includes a coil having a central portion and a plurality of arms coupled to the central portion. At least a portion of the coil includes a plurality of layers and a path exists between the plurality of layers, wherein a portion of an article is movable along the path from a first end of the coil where the coil is disconnected from the article to a predetermined position where the coil is connected to the article. A cover or gripping member is coupled to the coil. The cover or gripping member includes a first element having a first coupling mechanism and a second element having a second coupling mechanism. The first and second elements are independent pieces that are placed around the coil and fastened together by a user to secure the coil, the first element and the second element together as a unitary structure. A third element, which may be integrated with the second element or separately connected thereto, may also be employed.

20 Claims, 18 Drawing Sheets

PULL TAB APPARATUS

BACKGROUND OF THE INVENTION

1. Field of the Invention

The present invention generally relates to a pull tab apparatus, and more particularly, to a pull tab apparatus that is easily connected to and disconnected from an external item such as a slide fastener and/or other item/article by a user, and is also easily assembled and disassembled by the user.

2. Background Information

Articles such as slide fasteners often rely on a pull tab apparatus for effective operation. For example, a pull tab apparatus may be manipulated by a user to move a slide fastener such as a zipper in various directions. Pull tab apparatuses and/or slide fasteners may be used for various items/articles such as clothing garments, garment bags, backpacks, purses, luggage, camping equipment, vehicle/boat covers, and/or other items/articles.

With current pull tab apparatuses and slide fasteners, a problem arises when a pull tab apparatus breaks. In particular, when such breakage occurs, a user may be prevented from using the slide fastener. For example, certain slide fasteners such as zippers may include a locking mechanism in the zipper head that must be disengaged before the zipper can be moved in any direction. Accordingly, when a pull tab apparatus breaks with such a zipper, the locking mechanism may remain engaged and thereby prevent the zipper from being used. One solution to the foregoing problem is to replace the entire zipper head. While the cost of replacement parts with this approach may be relatively small, the labor costs can be cost-prohibitive for many users.

A desirable design for a pull tab apparatus capable of addressing the foregoing problems is disclosed in U.S. Pat. No. 7,213,306 issued on May 8, 2007 to the inventor of the current application. The pull tab apparatus disclosed herein is deemed to be an inventive variation and/or improvement over the pull tab apparatus disclosed in the '306 patent. The present invention described herein addresses these and/or other issues.

BRIEF SUMMARY OF THE INVENTION

In accordance with an aspect of the present invention, a pull tab apparatus for an article such as a slide fastener is disclosed. According to exemplary embodiments, the pull tab apparatus comprises: a coil having a first end and a second end and being configured to include a first section exhibiting a first shape and a second section exhibiting a second shape, wherein one of the first and second sections includes a central portion and the other one of the first and second sections includes a plurality of arms coupled to the central portion, wherein at least one of the first and second sections includes a plurality of layers and a path exists between the plurality of layers, wherein a portion of the article is movable along the path from one of the first and second ends where the coil is disconnected from the article to a predetermined position where the coil is connected to the article; and a gripping member coupled to the coil, wherein the gripping member comprises a first element including first coupling means and a second element including second coupling means, wherein the coil is positioned between the first and second elements and the first coupling means is coupled to the second coupling means to secure the coil, the first element and the second element together as a unitary structure.

In accordance with another aspect of the present invention, the pull tab apparatus comprises: a coil including a central portion and a plurality of arms coupled to the central portion, wherein at least a portion of the coil includes a plurality of layers and a path exists between the plurality of layers, wherein a portion of an article is movable along the path from a first end of the coil where the coil is disconnected from the article to a predetermined position where the coil is connected to the article; and a cover coupled to the coil, wherein the cover comprises a first element including first coupling means and a second element including second coupling means, wherein the first and second elements are independent pieces that are placed around the coil and the first and second coupling means are coupled together by a user to secure the coil, the first element and the second element together as a unitary structure.

In accordance with yet another aspect of the present invention, a method for assembling and/or enabling the assembly of a pull tab apparatus is disclosed. According to exemplary embodiments, the method comprises providing a coil including a central portion and a plurality of arms coupled to the central portion, wherein at least a portion of the coil includes a plurality of layers and a path exists between the plurality of layers; enabling a user to move a portion of an article along the path from a first end of the coil where the coil is disconnected from the article to a predetermined position where the coil is connected to the article; providing a gripping member including a first element and a second element, wherein the first and second elements are independent pieces and the first element includes first coupling means and the second element includes second coupling means; and enabling the user to couple the gripping member to the coil by placing the first and second elements around the coil and coupling the first and second coupling means to thereby secure the coil, the first element and the second element together as a unitary structure.

The aforementioned brief summary of exemplary embodiments of the present invention is merely illustrative of the inventive concepts presented herein, and is not intended to limit the scope of the present invention in any manner.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

Figure 1:
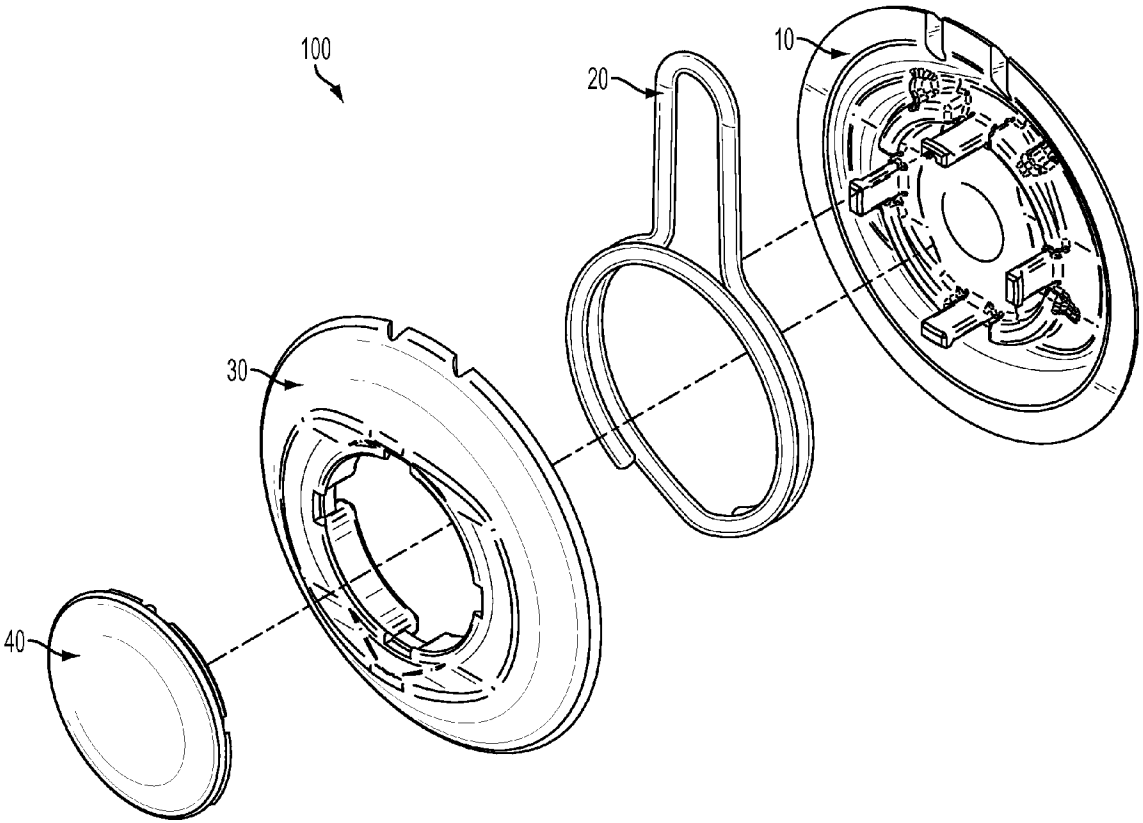
FIGS. 1 and 2 show exploded perspective views of a pull tab apparatus according to exemplary embodiments of the present invention.
Figure 2:
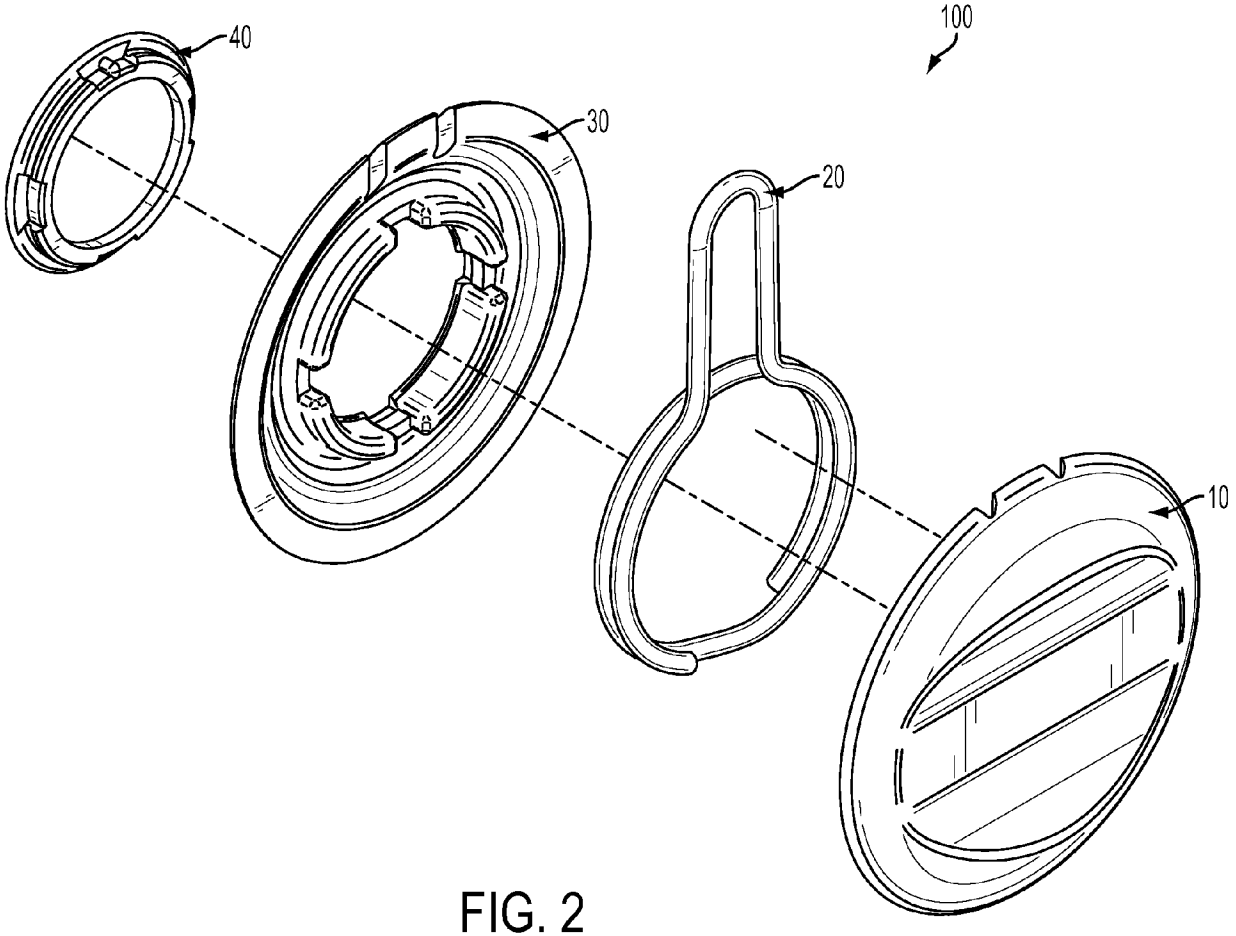

Referring now to the drawings, and more particularly to FIGS. 1 and 2, exploded perspective views of a pull tab apparatus 100 according to exemplary embodiments of the present invention are shown. As indicated in FIGS. 1 and 2, pull tab apparatus 100 comprises a first element 10, a coil 20, a second element 30, and a third element 40 which may be assembled together to form a unitary structure. According to certain exemplary embodiments, second and third elements 30 and 40 in FIGS. 1 and 2 may be integrated together such that the combination of these elements 30 and 40 represents a unitary structure/element.

According to principles of the present invention, pull tab apparatus 100 is easily connected to and disconnected from an external item such as a slide fastener and/or other article by a user, and is also easily assembled and disassembled by the user. According to the exemplary embodiments depicted in FIGS. 1 and 2, coil 20 is first connected to the external item in question via a process that will be described later herein.

Once coil 20 is secured to the item/article in question, elements 10 and 30 positioned on opposite front and rear faces of coil 20 are fastened (e.g., snap-fit) together in a "sandwiched" manner around coil 20 to thereby form a unitary structure that is fixedly attached to the item in question. As part of this process, coil 20 (as secured to the item/article in question) may first be connected to first element 10. According to exemplary embodiments, a central portion (e.g., circular portion in FIGS. 1 and 2) of coil 20 is coupled to (e.g., snap-fit, etc.) and/or placed upon first coupling means (e.g., projections/tabs/tangs, etc.) of first element 10.

Once coil 20 is placed upon and/or secured to first element 10, second element 30 is placed in a predetermined position over first element 10 and the two elements 10 and 30 are coupled (e.g., snap-fit) together in a "sandwiched" manner around coil 20 to thereby form a unitary structure comprised of first element 10, coil 20 and second element 30 that is fixedly attached to the item/article in question. According to exemplary embodiments, second element 30 includes second coupling means (e.g., recesses/apertures, etc.) corresponding to the first coupling means (e.g., projections/tabs/tangs, etc.) of first element 10 that enable the two elements 10 and 30 to be fixedly attached together in a secure manner. The combination of first and second elements 10 and 30 around the central portion of coil 20 forms a basic gripping member of pull tab apparatus 100.

In the aforementioned state in which first element 10, coil 20 and second element 30 are coupled together (and fixedly attached to the item/article in question), third element 40 may then be fastened (e.g., snap-fit) to second element 30 to thereby complete the assembly process and place pull tab apparatus 100 in an assembled state. Further exemplary details regarding each of the aforementioned elements 10 to 40 of pull tab apparatus 100 shown in FIGS. 1 and 2 and the assembly and disassembly processes will be described later herein.

Figure 3:
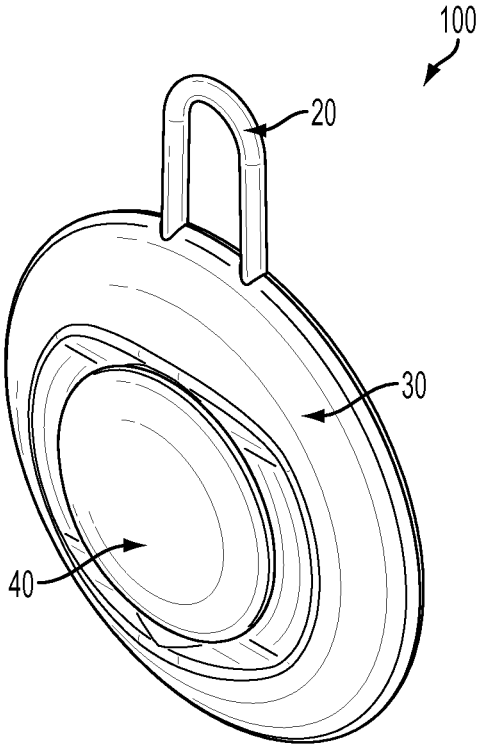
FIGS. 3 to 12 show various views of a pull tab apparatus in an assembled state according to exemplary embodiments of the present invention.
Figure 4:
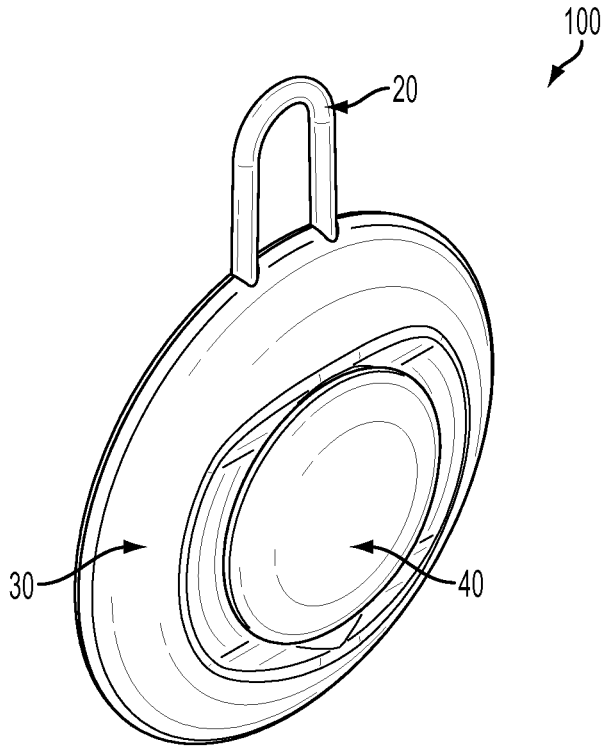
Figure 5:
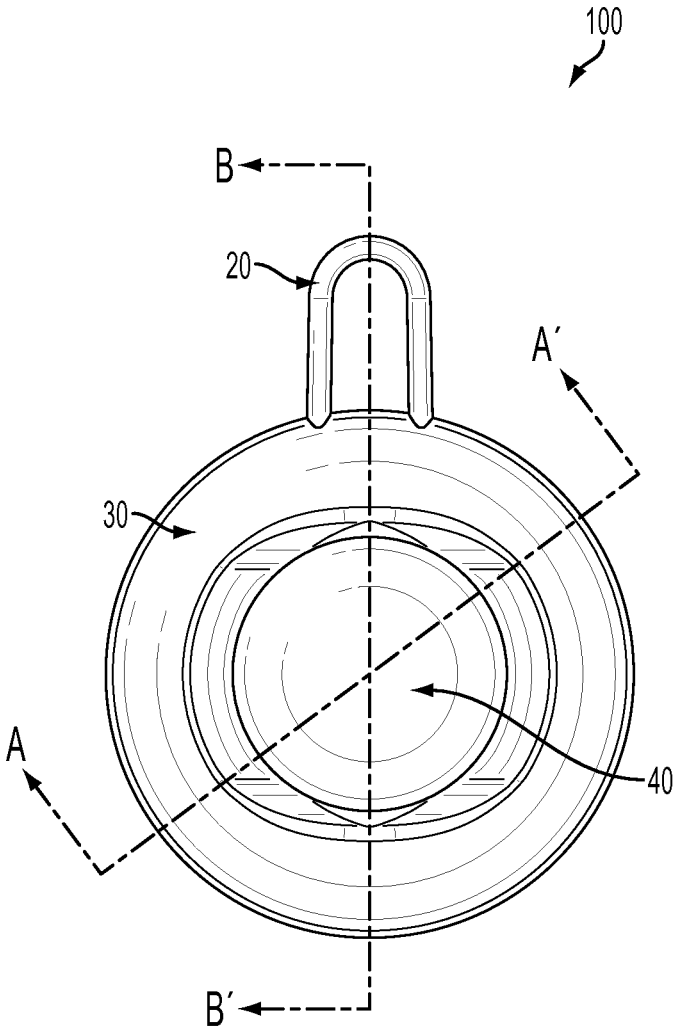
Figure 6:
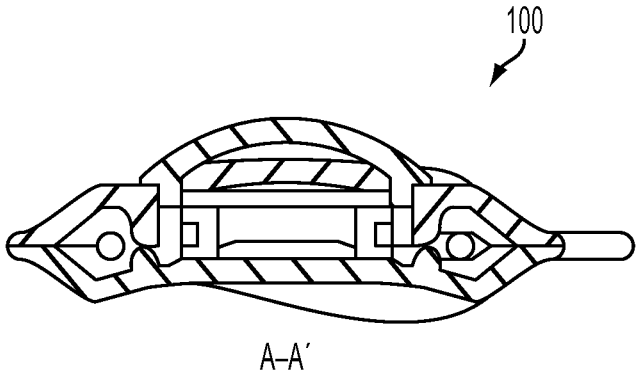
Figure 7:
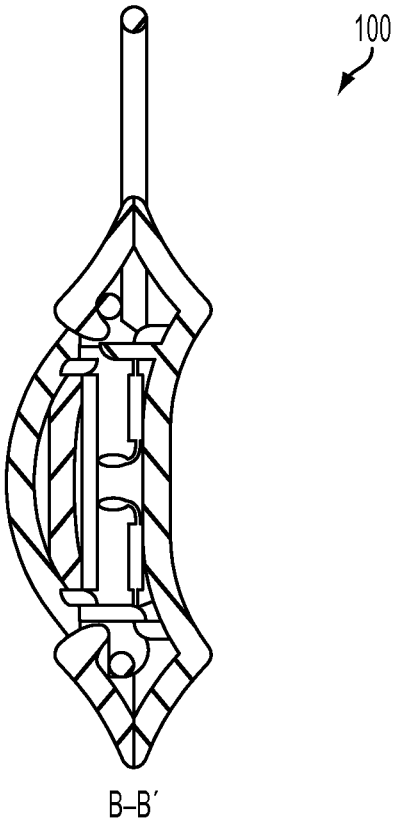
Figure 8:
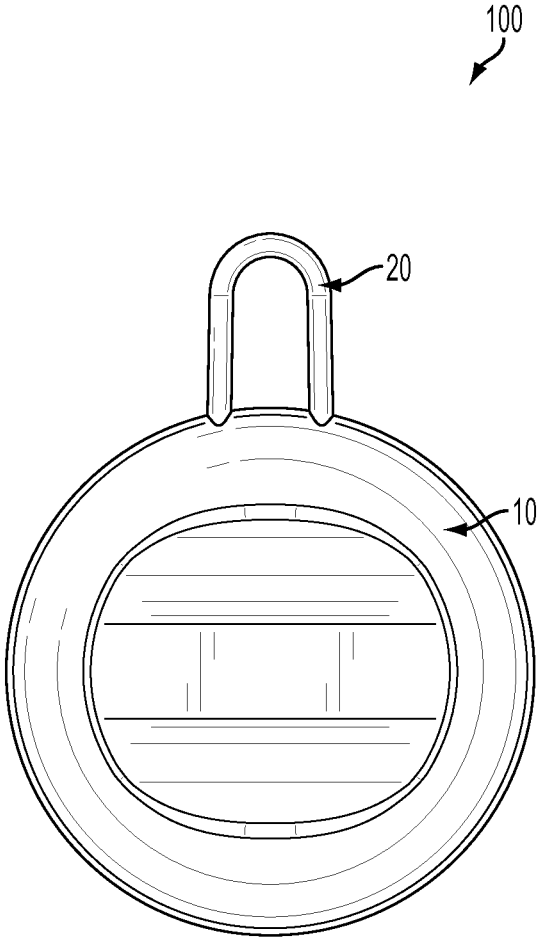
Figure 9:
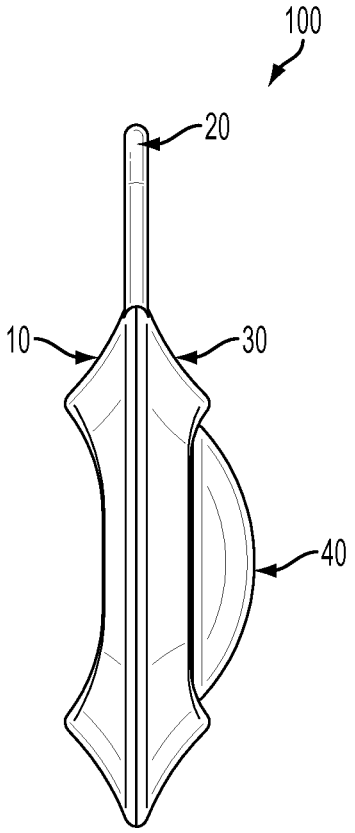
Figure 10:
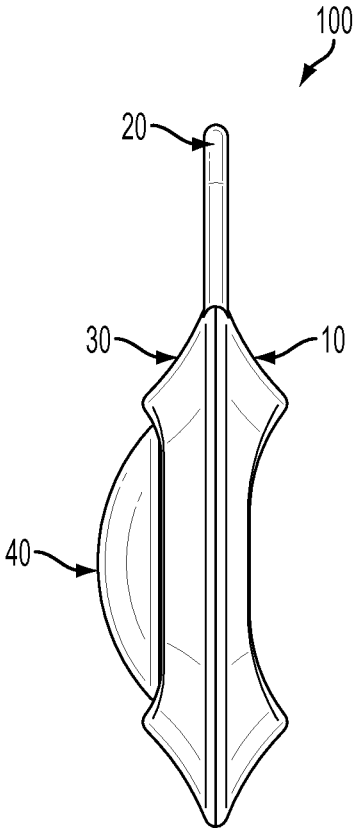
Figure 11:
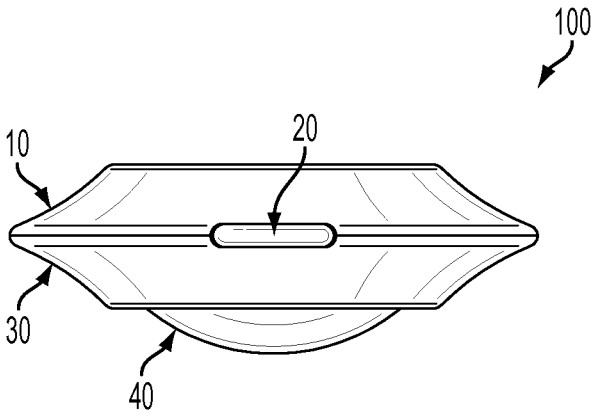
Figure 12:
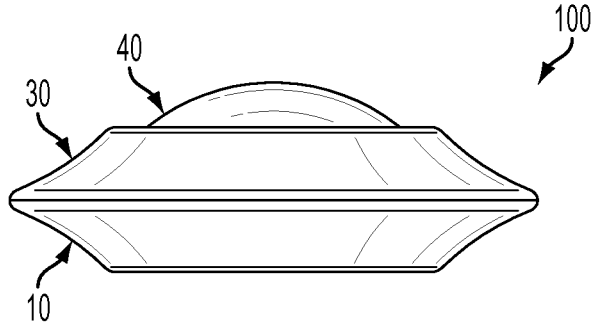
Figure 13:
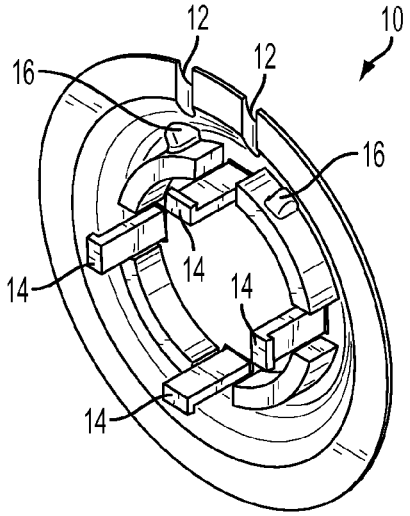
FIGS. 13 to 16 show various views of element 10 according to exemplary embodiments of the present invention.
Figure 14:
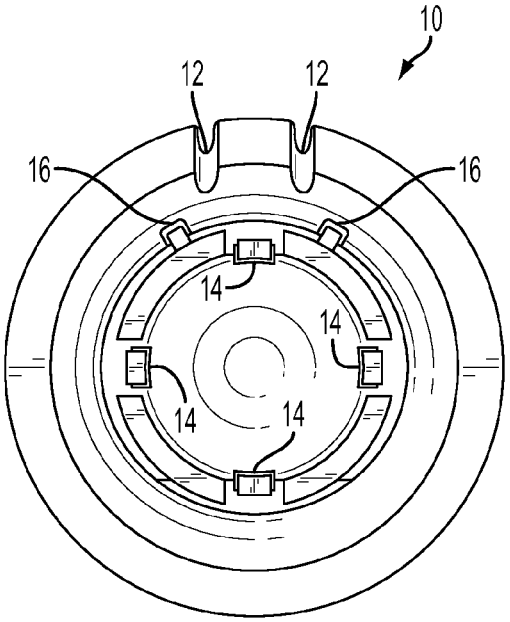

Referring to FIGS. 3 to 12, various views of pull tab apparatus 100 in the assembled state according to exemplary embodiments of the present invention are shown. Specifically, FIGS. 3 and 4 show perspective views of pull tab apparatus 100, FIG. 5 shows a front view of pull tab apparatus 100 highlighting cross-sections A-A' and B-B', FIG. 6 shows a cross-sectional view of pull tab apparatus 100 along section A-A', FIG. 7 shows a cross-sectional view of pull tab apparatus 100 along section B-B', FIG. 8 shows a rear view of pull tab apparatus 100, FIGS. 9 and 10 show sides views of pull tab apparatus 100, and FIGS. 11 and 12 show top and bottom views of pull tab apparatus 100.

Hereinafter, further exemplary details regarding each of the aforementioned elements 10 to 40 of pull tab apparatus 100 shown in FIGS. 1 to 12 will be provided.

Referring to FIGS. 13 to 16, various views of first element 10 of pull tab apparatus 100 according to exemplary embodiments of the present invention are shown. According to exemplary embodiments, first element 10 may be constructed using any material of suitable strength to enable use of pull tab apparatus 100 in its intended application, such as with a slide fastener (e.g., zipper). For example, first element 10 may be constructed using a polymeric, metallic and/or other material. Also according to exemplary embodiments, first element 10 is formed to exhibit a circular shape, although other shapes may also be used according to principles of the present invention as a matter of design choice.

As indicated in FIGS. 13 to 16, first element 10 includes a plurality of slots 12 formed therein, and first coupling means embodied as a plurality of projections/tabs/tangs 14 extending outwardly from a main body of first element 10 (other types of coupling means could also be employed according to principles of the present invention as a matter of design choice). According to exemplary embodiments, during the assembly process of pull tab apparatus 100, projections/tabs/tangs 14 of first element 10 are placed into an inner periphery of a central (e.g., circular) portion or first section of coil 20. Also according to exemplary embodiments, first element 10 comprises a plurality of notches 16 which may be used to facilitate an alignment and/or connection between first element 10 and coil 20 during the process of assembling pull tab apparatus 100.

According to exemplary embodiments, slots 12 of first element 10 accommodate passage of arms extending from coil 20. In some exemplary embodiments, slots 12 may be optional, in which case, slots 32 formed in second element 30 (as described later herein) completely accommodate passage of arms extending from the central portion of coil 20. Also according to exemplary embodiments, at least one of the projections/tabs/tangs 14 of first element 10 may include a notch, slot, aperture and/or recess formed therein (see, for example, dashed line extending from top projection/tab/tang of first element 10 in FIG. 1) capable of receiving a knob (shown and described later herein) of third element 40 during the process of assembling pull tab apparatus 100 and thereby securing first element 10, coil 20, second element 30 and third element 40 together (e.g., in a snap-fit manner). In this manner, the first coupling means (e.g., projections/tabs/tangs 14, etc.) of first element 10 may be advantageously functional to facilitate connections (e.g., snap-fit, etc.) between first element 10, coil 20 and second element 30, and in some exemplary embodiments, third element 40 as well.

Figure 15:
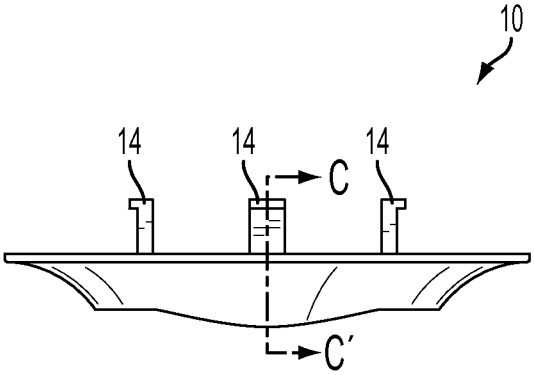
Figure 16:
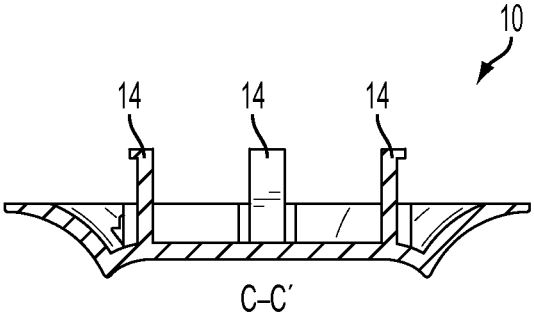
Figure 17:
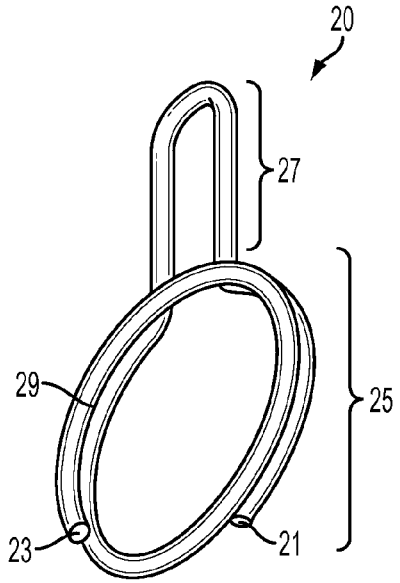
FIGS. 17 to 22 show various views of coil 20 according to exemplary embodiments of the present invention.
Figure 18:
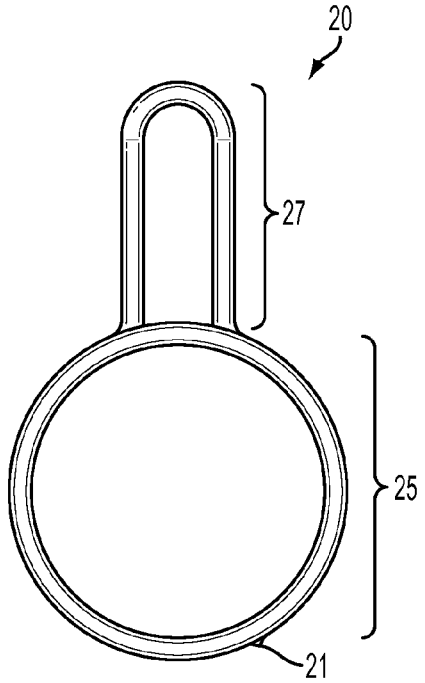
Figure 19:
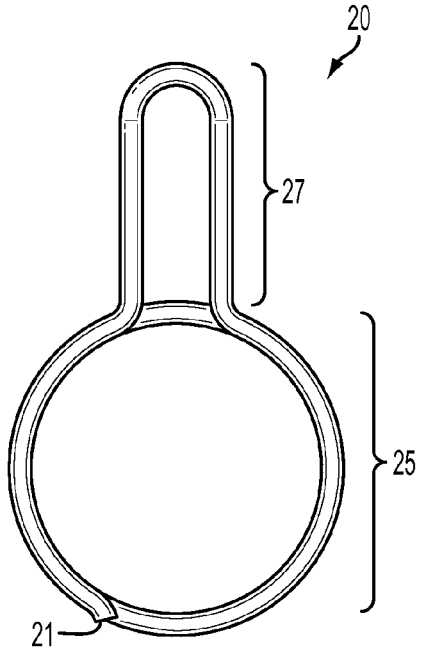
Figure 20:
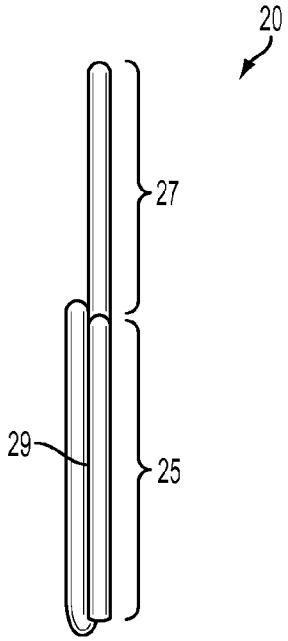
Figure 21:
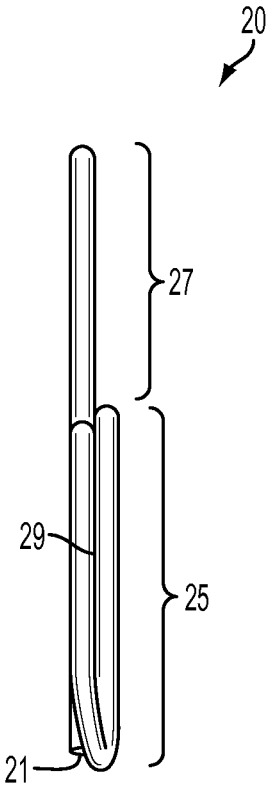
Figure 22:
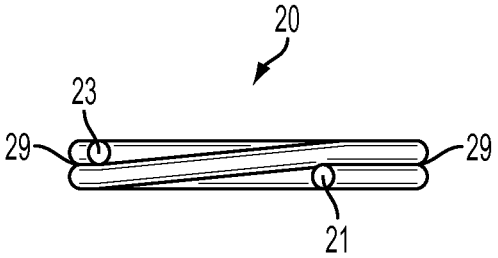
Figure 23:
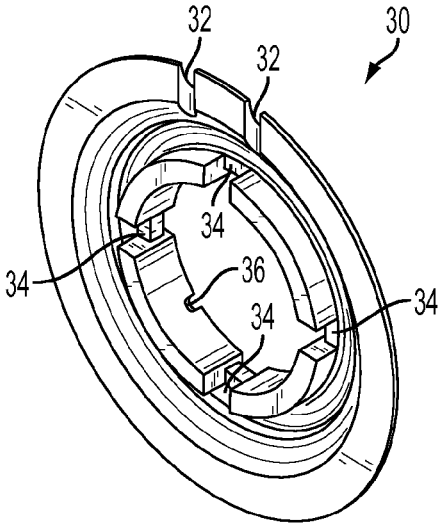
FIGS. 23 to 26 show various views of element 30 according to exemplary embodiments of the present invention.
Figure 24:
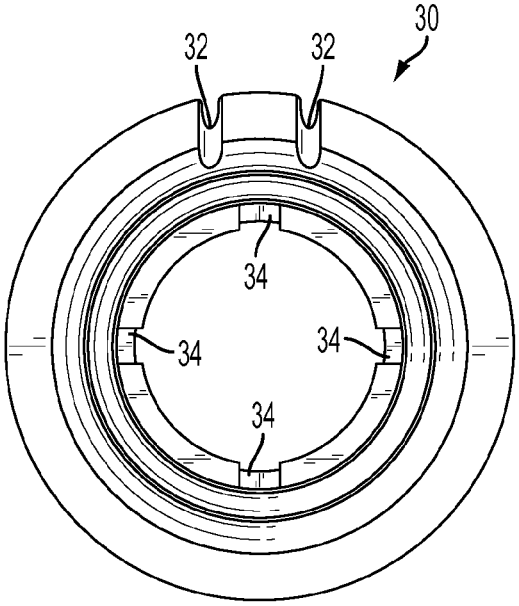

FIG. 15 shows a bottom view of first element 10 highlighting a cross-section C-C' and FIG. 16 shows a cross-sectional view along section C-C' according to exemplary embodiments of the present invention. According to exemplary embodiments, first element 10 may include any type of visual markings including text, logo, insignia, design and/or other markings.

Referring to FIGS. 17 to 22, various views of coil 20 of pull tab apparatus 100 according to exemplary embodiments of the present invention are shown. According to exemplary embodiments, coil 20 may be constructed using any material of suitable strength to enable use of pull tab apparatus 100 in its intended application, such as with a slide fastener (e.g., zipper). For example, coil 20 may be constructed using a polymeric, metallic and/or other material. Coil 20 may also include a coating (not expressly shown in FIGS.) such as a vinyl and/or other type of coating. The body of coil 20 may be formed in any suitable shape such as a columnar and/or cylindrical shape.

As indicated in FIGS. 17 to 22, coil 20 comprises a first end 21 and a second end 23, and is configured to include a first section 25 exhibiting a first shape and a second section 27 exhibiting a second shape. According to exemplary embodiments, first section 25 of coil 20 includes a central portion that generally exhibits a circular shape and comprises a plurality of layers that contact each other, or are substantially close to each other. Also according to exemplary embodiments, second section 27 of coil 20 generally exhibits an oblong, elongated shape and comprises a plurality of arms formed in a single layer. Such arms of second section 27 are coupled to and extend outwardly from the central portion of first section 25, and segments of such arms may be parallel and/or non-parallel to each other (parallel configuration shown in FIGS. for purposes of example and explanation). First and second sections 25 and 27 of coil 20 may also exhibit other shapes/configurations than those expressly shown, and the specific shapes/configurations used for each section 25 and 27 may be a matter of design choice.

According to exemplary embodiments, a path 29 exists between the respective layers in first section 25 of coil 20 to facilitate a connection between coil 20 and an external item/article, such as a slide fastener (not shown in FIGS.). Also according to exemplary embodiments, either first end 21 or second end 23 of coil 20 includes one or more indicators for assisting a user in selecting a starting point (i.e., end) for connecting coil 20 to the item/article in question. For example, the indicator may be embodied as one of ends 21 and 23 of coil 20 being colored and/or bent.

When attaching coil 20 and pull tab apparatus 100 to an external item/article such as a slide fastener (not shown in FIGS.), a user may first insert a latch portion of the item/article in question into path 29 at either first end 21 or second end 23 of coil 20 (i.e., according to the indicator(s)). The user may then manipulate the item/article and/or coil 20 to move the inserted latch portion of the item/article in question along path 29 from one end (e.g., first end 21) of coil 20 where pull tab apparatus 100 is disconnected from the item/article to the other end (e.g., second end 23) of coil 20 where pull tab apparatus 100 is connected to the item/article. The reverse operation may be performed to disconnect coil 20 and pull tab apparatus 100 from the item/article.

As the latch portion of the item/article in question is moved along path 29 to connect or disconnect coil 20 and pull tab apparatus 100 to or from the item/article, the respective layers of first section 25 of coil 20 may become separated from each other and thereby displaced from their original orientation (as shown in FIGS.) to accommodate passage of the latch portion along path 29. In the aforementioned manner, coil 20 of pull tab apparatus 100 may be easily connected to and disconnected from an external item/article such as a slide fastener. Further embodiments for coil 20 may be shown in U.S. Pat. No. 7,213,306 issued on May 8, 2007, which is hereby incorporated by reference in its entirety.

Referring to FIGS. 23 to 26, various views of second element 30 of pull tab apparatus 100 according to exemplary embodiments of the present invention are shown. According to exemplary embodiments, second element 30 may be constructed using any material of suitable strength to enable use of pull tab apparatus 100 in its intended application, such as with a slide fastener (e.g., zipper). For example, second element 30 may be constructed using a polymeric, metallic and/or other material.

Also according to exemplary embodiments, second element 30 is formed to exhibit a circular shape with an opening (e.g., to receive third element 40), although other shapes/configurations may also be used according to principles of the present invention as a matter of design choice. Also according to exemplary embodiments, first and second elements 10 and 30 have matching or substantially similar shapes that facilitate their (e.g., snap-fit) connection.

As indicated in FIGS. 23 to 26, second element 30 includes a plurality of slots 32 formed therein for accommodating passage of the arms extending from the central portion of coil 20. In some exemplary embodiments, slots 32 may be optional, in which case, slots 12 formed in first element 10 would completely accommodate passage of the arms extending from coil 20. Second element 30 also comprises second coupling means embodied as a plurality of recesses 34 (other types of coupling means could also be employed according to principles of the present invention as a matter of design choice) for respectively receiving projections/tabs/tangs 14 of first element 10 to effectuate the assembly process of pull tab apparatus 100.

Also according to exemplary embodiments, second element 30 may include a slot 36 on a front face thereof (shown in FIG. 23) for receiving a knob (described later herein) of third element 40 to facilitate the assembly process of pull tab apparatus 100. According to exemplary embodiments, slot 36 is positioned on the front face of second element 30 at approximately the 4:30 clock location (relative to the arms of second section 27 of coil 20 generally pointing in the 12:00 direction), although positions may also be employed according to principles of the present invention as a matter of design choice.

During the assembly process of pull tab apparatus 100, once coil 20 is placed upon and/or secured to first element 10, second element 30 is placed in a predetermined position over first element 10 (e.g., aligning slots 12 and 32 around the arms of second section 27 of coil 20) and the two elements 10 and 30 are coupled (e.g., snap-fit via elements 14 and 34) together in a "sandwiched" manner around coil 20 to thereby form a unitary structure comprised of first element 10, coil 20 and second element 30 that is fixedly attached to the item/article in question. The combination of first and second elements 10 and 30 around a central portion of coil 20 forms a basic gripping member and/or cover of pull tab apparatus 100.

Also according to exemplary embodiments, the aforementioned combination of first and second elements 10 and 30 around a central portion of coil 20 may be advantageously and easily disassembled by the user pressing into the opening formed in second element 30 (i.e., which is functional to receive third element 40 in certain exemplary embodiments) with sufficient force to physically separate the (e.g., snap-fit) connection between first element 10 and second element 30.

Figure 25:
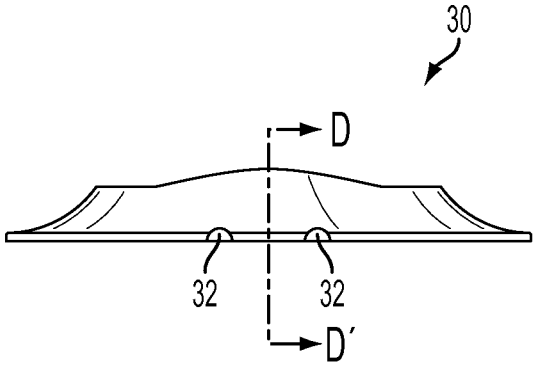
Figure 26:
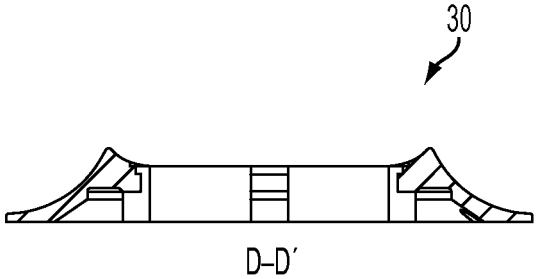
Figure 27:
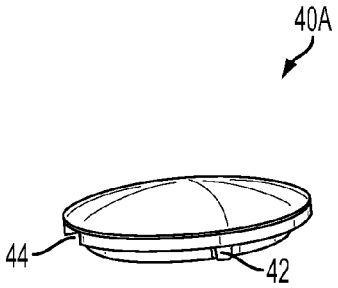
FIGS. 27 to 34 show various views of element 40 according to exemplary embodiments of the present invention.
Figure 28:
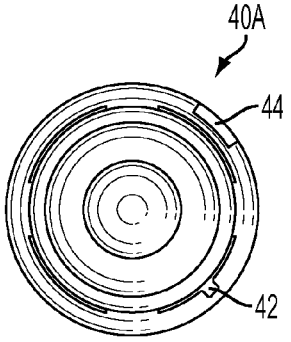

FIG. 25 shows a top view of second element 30 highlighting a cross-section D-D' and FIG. 26 shows a cross-sectional view along section D-D' according to exemplary embodiments of the present invention. According to exemplary embodiments, second element 30 may include any type of visual markings including text, logo, insignia, design and/or other markings.

Referring now to FIGS. 27 to 34, various views of third element 40 of pull tab apparatus 100 according to exemplary embodiments of the present invention are shown. According to exemplary embodiments, third element 40 may be constructed using any material of suitable strength to enable use of pull tab apparatus 100 in its intended application, such as with a slide fastener (e.g., zipper). For example, third element 40 may be constructed using a polymeric, metallic and/or other material.

According to principles of the present invention, third element 40 may be embodied in accordance with a variety of different designs, and may thus be implemented in a plurality of different configurations. The exemplary embodiments presented herein specifically show third element 40 in two different configurations, namely with a circular shape and relatively flat top in FIGS. 27 to 30 (labeled 40A), and with a circular shape and dome-shaped top in FIGS. 31 to 34 (labeled 40B). Other types of designs and/or configurations for third element 40 may also be employed in accordance with the principles of the present invention as a matter of design choice.

Referring to FIGS. 27 to 30, the first exemplary configuration of third element 40 (labeled 40A) is shown. According to exemplary embodiments, third element 40A includes at least one reference mark at one or more predetermined locations for indicating to a user a proper position for aligning second element 30 and third element 40A during the assembly process of pull tab apparatus 100.

As indicated in FIGS. 27 to 30, third element 40A comprises a knob 42 and a notch 44 positioned apart by a predetermined angular distance for enabling this alignment. According to exemplary embodiments, knob 42 and notch 44 are separated by an angular distance of approximately ninety (90) degrees (i.e., by three (3) hours in a conventional clock framework) as shown in the FIGS., although other distances may also be used according to principles of the present invention as a matter of design choice.

According to exemplary embodiments, knob 42 of third element 40A is received (e.g., in a snap-fit manner, etc.) by slot 36 on the front face of second element 30 (shown in FIG. 23) during the assembly process of pull tab apparatus 100. As indicated above herein, slot 36 may be positioned on the front face of second element 30 at approximately the 4:30 clock location (relative to the arms of second section 27 of coil 20 generally pointing in the 12:00 direction). In this exemplary embodiment, where knob 42 and notch 44 are separated by an angular distance of approximately ninety (90) degrees, notch 44 may be positioned at approximately the 7:30 clock location. This specific configuration of knob 42 and notch 44 may be particularly advantageous in the exemplary embodiments of pull tab apparatus 100 described herein since knob 42 and notch 44 are respectively positioned (e.g., symmetrically) at opposite ends of a ridge formed on a lower front face of second element 30 (see, for example, FIGS. 9 and 10). Of course, other positions and/or gaps for both slot 36 and knob 42 may also be employed according to principles of the present invention as a matter of design choice.

For example, slot 36 of second element 30 may be positioned on the front face of second element 30 at approximately the 12:00 clock location (relative to the arms of second section 27 of coil 20 generally pointing in the 12:00 direction). As indicated above herein, first element 10 may include a notch, slot, aperture and/or recess formed therein at approximately the 12:00 clock location (see, for example, dashed line extending from top projection/tab/tang of first element 10 in FIG. 1) capable of receiving knob 42 of third element 40A (e.g., in a snap-fit manner, etc.) during the process of assembling pull tab apparatus 100 and thereby securing first element 10, coil 20, second element 30 and third element 40A together (e.g., in a snap-fit manner, etc.). In this manner, the first coupling means (e.g., projections/tabs/tangs 14, etc.) of first element 10 may be advantageously functional to facilitate a plurality of different connections in the assembly of pull tab apparatus 100, including multiple connections (e.g., snap-fit, etc.) between first element 10, coil 20, second element 30, and third element 40A.

According to exemplary embodiments, notch 44 advantageously enables the user to remove third element 40A from the opening of second element 30 when, for example, disassembling pull tab apparatus 100. For example, notch 44 may be accessed by any suitable object such as a user's fingernail, the tip of a screwdriver and/or other means for purposes of separating and removing third element 40A from the opening formed in second element 30. According to exemplary embodiments, notch 44 is not visible to a user in a front view of pull tab apparatus 100 in the assembled state (see FIG. 5). Once third element 40A is removed from the opening of second element 30, the user may separate second element 30 from first element 10 by applying suitable pressure (e.g., pressing with a finger, etc.) into the opening and thereby disassembling pull tab apparatus 100.

Figure 29:
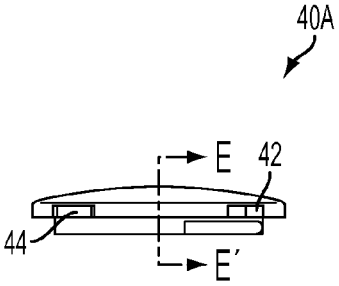
Figure 30:
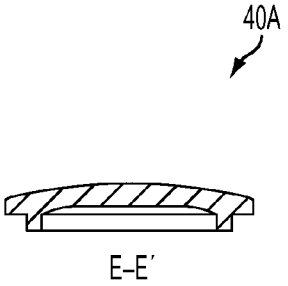
Figure 31:
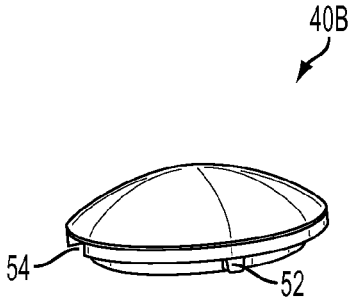
Figure 32:
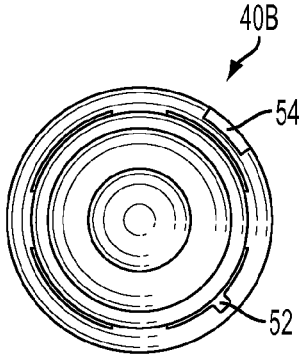

FIG. 29 shows a side view of third element 40A highlighting a cross-section E-E' and FIG. 30 shows a cross-sectional view along section E-E' according to exemplary embodiments of the present invention. According to exemplary embodiments, third element 40A may include any type of visual markings including text, logo, insignia, design and/or other markings.

Referring to FIGS. 31 to 34, the second exemplary configuration of third element 40 (labeled 40B) is shown. According to exemplary embodiments, third element 40B includes at least one reference mark at one or more predetermined locations for indicating to a user a proper position for aligning second element 30 and third element 40B during the assembly process of pull tab apparatus 100. As indicated in FIGS. 31 to 34, third element 40B comprises a knob 52 and a notch 54 positioned apart by a predetermined angular distance for enabling this alignment. According to exemplary embodiments, knob 52 and notch 54 are separated by an angular distance of approximately ninety (90) degrees (i.e., by three (3) hours in a conventional clock framework) as shown in the FIGS., although other distances may also be used according to principles of the present invention as a matter of design choice.

According to exemplary embodiments, knob 52 of third element 40B is received (e.g., in a snap-fit manner, etc.) by slot 36 on the front face of second element 30 (shown in FIG. 23) during the assembly process of pull tab apparatus 100. As indicated above herein, slot 36 may be positioned on the front face of second element 30 at approximately the 4:30 clock location (relative to the arms of second section 27 of coil 20 generally pointing in the 12:00 direction). In this exemplary embodiment, where knob 52 and notch 54 are separated by an angular distance of approximately ninety (90) degrees, notch 54 may be positioned at approximately the 7:30 clock location. This specific configuration of knob 52 and notch 54 may be particularly advantageous in the exemplary embodiments of pull tab apparatus 100 described herein since knob 52 and notch 54 are respectively positioned (e.g., symmetrically) at opposite ends of a ridge formed on a lower front face of second element 30 (see, for example, FIGS. 9 and 10). Of course, other positions and/or gaps for both slot 36 and knob 52 may also be employed according to principles of the present invention as a matter of design choice.

For example, slot 36 of second element 30 may be positioned on the front face of second element 30 at approximately the 12:00 clock location (relative to the arms of second section 27 of coil 20 generally pointing in the 12:00 direction). As indicated above herein, first element 10 may include a notch, slot, aperture and/or recess formed therein at approximately the 12:00 clock location (see, for example, dashed line extending from top projection/tab/tang of first element 10 in FIG. 1) capable of receiving knob 52 of third element 40B (e.g., in a snap-fit manner, etc.) during the process of assembling pull tab apparatus 100 and thereby securing first element 10, coil 20, second element 30 and third element 40B together (e.g., in a snap-fit manner, etc.). In this manner, the first coupling means (e.g., projections/tabs/tangs 14, etc.) of first element 10 may be advantageously functional to facilitate at least three different connections in the assembly of pull tab apparatus 100, including connections (e.g., snap-fit, etc.) between first element 10, coil 20, second element 30, and third element 40B.

According to exemplary embodiments, notch 54 advantageously enables the user to remove third element 40B from the opening of second element 30 when, for example, disassembling pull tab apparatus 100. For example, notch 54 may be accessed by any suitable object such as a user's fingernail, the tip of a screwdriver and/or other means for purposes of separating and removing third element 40B from the opening formed in second element 30. According to exemplary embodiments, notch 54 is not visible to a user in a front view of pull tab apparatus 100 in the assembled state (see FIG. 5). Once third element 40B is removed from the opening of second element 30, the user may separate second element 30 from first element 10 by applying suitable pressure (e.g., pressing with a finger, etc.) into the opening and thereby disassembling pull tab apparatus 100.

Figure 33:
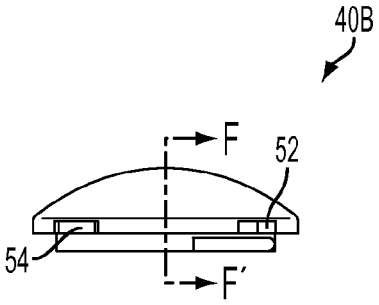
Figure 34:
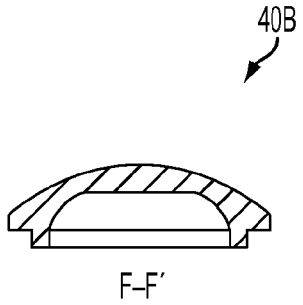

FIG. 33 shows a side view of third element 40B highlighting a cross-section F-F' and FIG. 34 shows a cross-sectional view along section F-F' according to exemplary embodiments of the present invention. According to exemplary embodiments, third element 40B may include any type of visual markings including text, logo, insignia, design and/or other markings.

As described herein, the present invention provides a pull tab apparatus that is, among other things, easily connected to and disconnected from an external item such as a slide fastener and/or other item/article by a user, and is also easily assembled and disassembled by the user.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pull tab apparatus, comprising:

a coil having a first end and a second end and being configured to include a first section exhibiting a first shape and a second section exhibiting a second shape, wherein one of said first and second sections includes a central portion and the other one of said first and second sections includes a plurality of arms coupled to said central portion, wherein at least one of said first and second sections includes a plurality of layers and a path exists between said plurality of layers, wherein a portion of an article is movable along said path from one of said first and second ends where said coil is disconnected from said article to a predetermined position where said coil is connected to said article; and a gripping member coupled to said coil, wherein said gripping member comprises a first element including first coupling means and a second element including second coupling means, wherein said coil is positioned between said first and second elements and said first coupling means is coupled to said second coupling means to secure said coil, said first element and said second element together as a unitary structure.

2. The pull tab apparatus of claim 1, wherein:

said first coupling means comprises a plurality of projections that extend outwardly from said first element around said central portion of said coil;

said second coupling means comprises a plurality of recesses for respectively receiving said plurality of projections; and said first and second elements snap fit together.

3. The pull tab apparatus of claim 1, wherein said central portion includes a circular region and said arms include sections that are parallel.

4. The pull tab apparatus of claim 1, wherein at least one of said first and second elements includes a plurality of slots for accommodating passage of said arms of said coil from an interior portion of said gripping member to an exterior portion of said gripping member.

5. The pull tab apparatus of claim 1, wherein said gripping member further comprises a third element coupled to said first and second elements.

6. The pull tab apparatus of claim 5, wherein:

said second element includes an opening; and said third element snap fits into said opening.

7. The pull tab apparatus of claim 6, wherein:

said third element includes at least one reference mark at one or more predetermined locations; and said at least one reference mark indicates to a user a proper position for aligning said second and third elements for assembly.

8. The pull tab apparatus of claim 7, wherein said at least one reference mark further enables said user to remove said third element from said opening.

9. The pull tab apparatus of claim 6, wherein at least one of said second and third elements includes at least one of text, a logo, an insignia and a design.

10. The pull tab apparatus of claim 1, wherein one of said first and second ends of said coil includes an indicator for assisting a user in connecting said coil to said article.

11. The pull tab apparatus of claim 10, wherein said indicator includes at least one of a colored portion of said coil and a bent portion of said coil.

12. The pull tab apparatus of claim 1, wherein said article is a slide fastener.

13. A pull tab apparatus, comprising:

a coil including a central portion and a plurality of arms coupled to said central portion, wherein at least a portion of said coil includes a plurality of layers and a path exists between said plurality of layers, wherein a portion of an article is movable along said path from a first end of said coil where said coil is disconnected from said article to a predetermined position where said coil is connected to said article; and a cover coupled to said coil, wherein said cover comprises a first element including first coupling means and a second element including second coupling means, wherein said first and second elements are independent pieces that are placed around said coil and said first and second coupling means are coupled together by a user to secure said coil, said first element and said second element together as a unitary structure.

14. The pull tab apparatus of claim 13, wherein said cover further comprises a third element coupled to said first and second elements.

15. The pull tab apparatus of claim 14, wherein:

said second element includes an opening; and said third element snap fits into said opening.

16. The pull tab apparatus of claim 15, wherein:

said third element includes at least one reference mark at one or more predetermined locations; and said at least one reference mark indicates to a user a proper position for aligning said second and third elements for assembly.

17. The pull tab apparatus of claim 16, wherein said at least one reference mark further enables said user to remove said third element from said opening.

18. The pull tab apparatus of claim 14, wherein at least one of said first, second and third elements includes at least one of text, a logo, an insignia and a design.

19. A method, comprising:

providing a coil including a central portion and a plurality of arms coupled to said central portion, wherein at least a portion of said coil includes a plurality of layers and a path exists between said plurality of layers;

enabling a user to move a portion of an article along said path from a first end of said coil where said coil is disconnected from said article to a predetermined position where said coil is connected to said article;

providing a gripping member including a first element and a second element, wherein said first and second elements are independent pieces and said first element includes first coupling means and said second element includes second coupling means; and enabling said user to couple said gripping member to said coil by placing said first and second elements around said coil and coupling said first and second coupling means to thereby secure said coil, said first element and said second element together as a unitary structure.

20. The method of claim 19, further comprised of enabling said user to fixedly attach a third element to said unitary structure.

* * * * *